United States Patent [19]

Rosenberg

[11] Patent Number: 4,625,675

[45] Date of Patent: Dec. 2, 1986

[54] DIET MANAGEMENT DEVICE

[76] Inventor: Harvey Rosenberg, 1552 Skyhawk Rd., Escondido, Calif. 92025

[21] Appl. No.: 790,795

[22] Filed: Oct. 24, 1985

Related U.S. Application Data

[63] Continuation of Ser. No. 565,585, Dec. 27, 1983, abandoned.

[51] Int. Cl.[4] ..... G09F 9/45

[52] U.S. Cl. ..... 116/324; 116/334

[58] Field of Search ..... 116/325, 323, 324, 315, 116/311, 312, 334, DIG. 46; 235/124, 89 R

[56] References Cited

U.S. PATENT DOCUMENTS

| | | | |
|---|---|---|---|
| 2,299,284 | 10/1942 | Steidemann | 116/324 |
| 2,828,713 | 4/1958 | Smith | 116/324 |
| 2,965,292 | 12/1960 | Lewis | 116/323 |
| 3,289,931 | 12/1966 | Bennett | 235/89 R |
| 3,584,597 | 6/1971 | Simmons | 116/120 |
| 3,763,820 | 10/1973 | Sage | 116/135 |
| 3,841,260 | 10/1974 | Sharp | 116/136 |

OTHER PUBLICATIONS

"Exchange Lists for Meal Planning", American Diabetes Association Inc., The American Dietetic Association, copyright 1976.

*Primary Examiner*—Charles Frankfort
*Assistant Examiner*—Denis E. Corr
*Attorney, Agent, or Firm*—Roberts and Quiogue

[57] ABSTRACT

A diet management device which includes a housing; respective manually actuated detented slide members respectively associated with each of predetermined food groups; and a respective numerical display for each detented slide member for providing numerical indicia as a function of the position of the respective detented slide member. The diet management device further includes for predetermined daily calorie limits respective removable encoded card inserts for cooperating with the slide members to set the initial positions of the slide members. The initial positions provide for the predetermined food groups indications of the respective maximum amounts of food which can be consumed for a predetermined daily calorie intake. The respective slide members are moved to decrement the respective displayed numerical indicia pursuant to the intake of food.

7 Claims, 5 Drawing Figures

DIET MANAGEMENT DEVICE

This application is a continuation of application Ser. No. 565,585, filed 12-27-83, now abandoned.

BACKGROUND OF THE INVENTION

1. Field of the Invention

The disclosed invention generally relates to diet management, and is more particularly directed to a diet management device for determining the amount of food intake necessary to achieve a balanced diet for a given daily calorie limit, and for monitoring food intake.

2. Description of the Background Art

It is generally recognized that a balanced diet includes several food groups, and a well-known diet management system generally called the "exchange diet" divides food into six groups or "exchanges." The exchange diet, originally developed for diabetics and now used by anyone wishing to control or lose weight, is more specifically discussed in the booklet entitled "Exchange List For Meal Planning," prepared by the American Diabetes Association, Inc. and the American Dietetic Association. In the terminology of the exchange diet, those food groups are typically called bread exchanges, meat exchanges, fat exchanges, fruit exchanges, milk exchanges, and vegetable exchanges, thereby referring to specific food groups. The "exchange" is a unit of food which may be different for each food group. However, within a particular food group each exchange is approximately equal in calories and in the amount of carbohydrate, protein and fat. Also, each exchange within each group contains similar minerals and vitamins. For each food group, an "exchange list" is provided which sets forth the amount of a specific food that constitutes an exchange. For example, in the above-identified booklet, a small apple is one fruit exchange, as is one-fourth of a cantaloupe melon.

The exchange diet further specifies the number of exchanges for each food group for a specified daily caloric intake. For example, for a daily two thousand (2,000) calorie intake, a person is allowed nine (9) bread exchanges, nine (9) meat exchanges, four (4) fat exchanges, six (6) fruit exchanges, three (3) milk exchanges, and two (2) vegetable exchanges.

A person utilizing the exchange diet system for a predetermined daily calorie intake would have to (i) determine the number of exchanges allowed for each food group, (ii) keep track of the number of exchanges consumed in each food group, and (iii) keep track of the number of exchanges remaining in each food group. Typically, such information would have to be processed and maintained by memory, by notes, or by predetermined menus. Obviously, these procedures are cumbersome and prone to error.

A mechanized exchange diet management system is disclosed in U.S. Pat. No. 3,841,260, issued to Sharp, et al. on Oct. 15, 1974. The Sharp, et al. system includes a sheet member with an array of holes aligned in columns and rows. Separate groups of contiguous columns are respectively color coded to represent the six different food groups. Color coded pegs, each apparently representing one exchange for the food group identified by the color of the peg, are inserted into the holes of the sheet member at appropriate locations. The locations of the color coded pegs identify the types and quantities of foods which may be served in a twenty-four (24) hour period, the types and quantities of foods which have been consumed so far for such twenty-four (24) hour period, and the types and quantities of foods which can still be consumed. On the inside of the cover for the Sharp, et al. device are listings of foods in each food group and a column which specifies the number of exchanges for each group for certain calorie intake limits.

While the Sharp, et al. device provides for systematic monitoring of exchange limits and exchanges consumed, it is still awkward and cumbersome to use on a daily basis. Moreover, it appears to be bulky and not readily carried by the user.

The prior art also includes devices for keeping track of numerical indicia such as game scores and trip mileage. For example, U.S. Pat. No. 3,584,597 discloses a device for scoring segments of a golf game and includes movable score indicating members which are moved to display the appropriate scores. U.S. Pat. No. 3,763,820 discloses a key chain tag which includes finger adjustable members for positioning numbers within a pair of viewing windows. Such numbers are intended to indicate start and finish mileages for a motor trip. Obviously, neither of the two foregoing devices directly pertain to diet management.

SUMMARY OF THE INVENTION

An object of the invention is to provide a diet management device which identifies for predetermined food groups and for a predetermined daily calorie intake the respective maximum allowable amounts of food which can be consumed.

Another object of the invention is to provide a diet management device which is easily and readily adapted to provide daily maximum food intake information for different predetermined daily calorie intakes and for different predetermined food groups.

Still another object of the invention is to provide a diet management device which indicates for predetermined food groups and for a predetermined daily calorie intake the respective amounts of food which can still be consumed during a particular day.

A further object of the invention is to provide a diet management device for keeping track for predetermined food groups respective amounts of food consumed in the course of a day.

A further object of the invention is to provide a diet management device which is easy to use and does not require complex tables.

Another object of the invention is to provide a diet management device which is compact, readily carried by the user, and easy to use.

Still another object of the invention is to provide a diet management device which on a daily basis for a predetermined calorie intake securely and accurately maintains for predetermined food groups respective information regarding amounts of food which can be consumed and amounts of food which can still be consumed.

The foregoing and other objects of the invention are achieved in a diet management device which includes a storage element for representing relative to a predetermined calorie intake the allowable amounts of food which can be consumed for predetermined food groups. Indicators cooperate with the storage element to indicate for the predetermined food groups the respective maximum amounts allowable, and also to indicate the respective amounts of food which can still be consumed.

BRIEF DESCRIPTION OF THE DRAWING

The foregoing and other features and advantages of the disclosed invention will be readily understood by persons skilled in the art from the following detailed description when read in conjunction with the drawing wherein.

DETAILED DESCRIPTION

Figure 1:
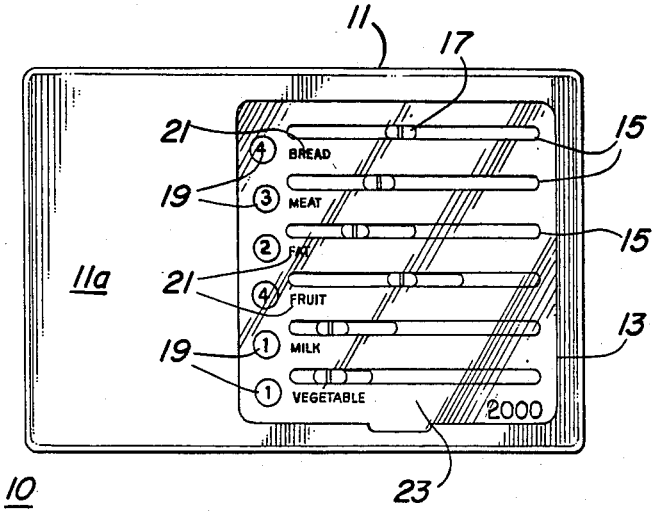
FIG. 1 is a front view of the diet management device of the invention.

In the drawing and in the following discussion, like elements in the different figures are identified by like reference numerals.

Figure 2:
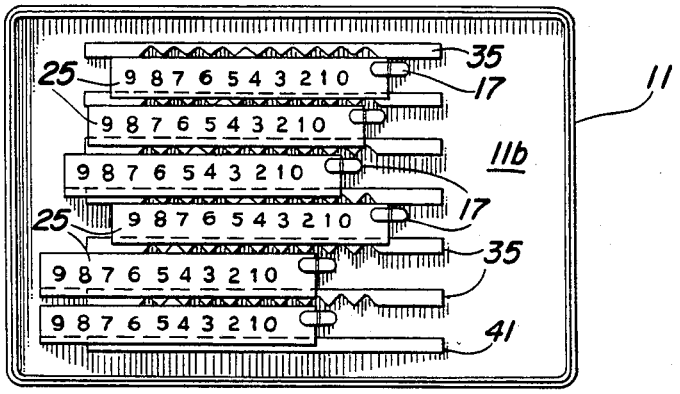
FIG. 2 is a view showing the inside mechanisms of the diet management device of FIG. 1.

The disclosed diet management device 10 includes a housing 11 which is preferably made of plastic or some other lightweight material, and includes a front 11*a* and a back 11*b* (FIG. 2). The front 11*a* of the housing 11 includes a display portion 13 which has a plurality of elongated slots 15. There are a total of six slots 15, with each slot being associated with a particular food group as defined in the exchange diet or any other diet system wherein food is divided into groups. Protruding up through each slot 15 is a respective tab 17 which is part of a detented slide mechanism discussed further below. The display portion 13 further includes respective display apertures 19 adjacent respectively associated slots 15. As further discussed below, the numerical indicia visible through one of the display apertures 19 is a function of the position of its associated tab 17. Adjacent each display aperture 19 is a respective food group identifier 21 which identifies the food group associated with a particular slot 15 and display aperture 19. Although specific food groups are identified by the food group identifiers 21, other food groups may also be readily identified, or some of the identified food groups may be omitted.

An encoded card insert 23 is removably secured in the display portion 13 of the diet management device 10. As discussed below relative to FIG. 5, the encoded card insert 23 limits the travel to the right of the tabs 17. By way of example, the encoded card insert 23 can be made of a transparent flexible plastic sheet which would be retained in grooves or channels around the periphery of the display portion 13. Also, the food group identifiers 21 may be readily imprinted on the encoded card insert 21 instead of on the display portion 13 of the housing 11 of the diet management device 10.

Figure 3:
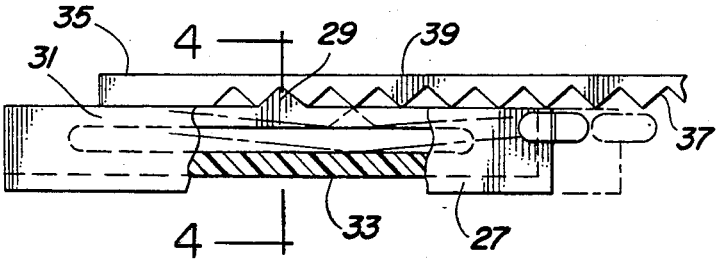
FIG. 3 is a detail view of a detented slide mechanism utilized in the diet management device of FIG. 1 and partially shown in FIG. 2.
Figure 4:
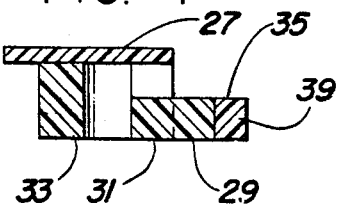
FIG. 4 is a sectional view of the detented slide mechanism shown in FIG. 3.

Referring now to FIGS. 2 and 3, each tab 17 is fixed to a slide member 25 which has a sequence of numbers shown by way of example as the numbers from zero (0) through nine (9) on an indicator face portion 27. Higher numbers could also be incorporated if appropriate. The back portion of each slide 25 includes a triangularly shaped locating tab 29 which protrudes from a resilient support arm 31 that is spaced from the indicating face portion 27 of the slide member 25. The resilient support arm 29 is fixed at its end portions to a linear guide 33. The linear guide 33 is attached along its length to the indicating face portion 27 of the slide member 25.

The locating tab 29 cooperates with a detent positioning bar 35 which includes a plurality of triangularly shaped detents 37. The detent bar 35 also includes a linear slide portion 39 opposite the detents 37. As shown in FIG. 2, each slide member 25 is located between detent position bars 35, except for the bottom slide 25, which has a guide member 41 adjacent its bottom portion. The detent position bars 35 and the guide member 41 are secured to the inner surface of the back 11*b* of the housing 11.

In operation, a slide member 25 has its linear guide 33 in contact with a linear slide portion which is provided by the position detent bars 35 or by the guide member 41, and further has its triangular locating tab 29 and resilient support arm 31 adjacent the triangular detents 37. As shown in FIG. 3, the resilient support arm 31 is downwardly biased when the locating tab 29 is not engaged in one of the detents 37. When the locating tab 29 is engaged in one of the detents 37, the resilient support arm 31 rests against the lower vertices formed by the detents 37.

The rear portion of the slide member 25 rests against the inner surface of the back 11*b* of the housing 11, and the inner surface of the front 11*a* of the housing 11 functions to maintain each slide member 25 between the detents 37 and a linear slide portion.

With the foregoing structure, each of the slide members 25 is readily positioned in accordance with one of the detents 37, and is easily moved from one detent position to another. The locations of the detents 37 and the numerical indicia on the indicator face portion 27 are determined so that for each detent position a distinct number is shown in the display aperture 19. Moving the tab 17 one detent position to the left will cause the next lower number to be visible through its associated display aperture 19. Similarly, moving a tab 17 to the right will cause the next higher number to be visible through its associated display aperture 19.

By way of example, the housing 11 includes two molded plastic pieces which respectively form the front 11*a* and the back 11*b* of the housing 11. The front 11*a* would include the display portion 13, the slots 15, the display apertures 19, and the food group identifiers 21. The front 11*a* would also include appropriate grooves or channels around the periphery of the display portion 13 to retain the encoded card insert 23. The back 11*b* would included the detent bars 35 and the guide member 41, all integrally molded as one piece. Also by way of example, each slide member 25 is a unitary molded structure which would include the tab 17, the indicator face portion 27, the triangular locating tab 29, the resilient support arm 31, and the linear guide 33.

Figure 5:
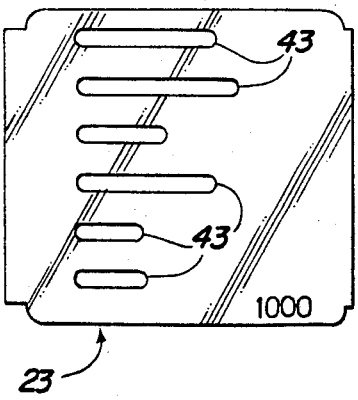
FIG. 5 shows an example of the different removable encoded card inserts for different predetermined daily calorie intakes which are individually utilized to control the travel of the detented slides of the diet management device of FIG. 1.

Referring now to FIG. 5, shown therein is an example of the encoded card insert 23 which is effectively a storage element wherein the stored information is represented by the respective lengths of the slots 43. The lengths of the respective slots 43 are representative of the maximum number of exchange units available for a given calorie intake, which by way of example is indicated as one thousand (1,000) calories on the card insert 23 shown in FIG. 5. When the overlay 23 is secured in the display portion of the diet management device 10, and the tabs 17 are located against the right-hand terminal portions of the slots 43, the numbers visible through the display apertures 19 specify the number of exchange units available for each of the respective food groups. Thus, for each different daily calorie intake limit, a different encoded card insert 23 is utilized. As mentioned previously, the card insert 23 can be a transparent, flexible plastic sheet. As also mentioned previously, the food group identifier 21 can be imprinted on the encoded card insert 23 instead of on the display portion 13. With such an encoded card insert 23, the slots 43 are punched to the appropriate dimensions.

The diet management device 10 is utilized by initially moving all of the tabs 17 to the left, which would cause zeros to be visible in each of the display apertures 19. An appropriate encoded card insert 23 for a given calorie intake is then inserted and secured in the display portion 13. The tabs 17 would then be moved against the right-hand limits of the encoded slots 43 of the encoded card insert 23. The numbers visible through the display apertures 19 would then indicate the maximum daily allowable food exchanges for each of the predetermined food groups. As an exchange for a particular food group is consumed, the appropriate tab 17 is moved to the left one detent, which then causes the associated numerical indicia visible through a display aperture 19 to be decremented by one. When a particular tab 17 is in its left-most position and its associated display indicates zero, the user then knows that the limit for that particular food group has been consumed. In this manner, the numerical indicia visible through the display apertures 19 are indicative of the number of exchanges which can still be consumed for the respective food group.

The diet management device 10 is then reset on a daily basis by repositioning the tabs 17 against the right-hand limits of the encoded slots 43 of the encoded card insert 23, and the above-described process of tracking food intake is appropriately repeated.

Although the foregoing has been a description of preferred embodiments of the invention, modifications and changes thereto can be made by persons skilled in the art without departing from the scope and spirit of the invention as defined by the following claims.

What is claimed is:

1. A hand-held portable diet management device for use relative to a plurality of predetermined food groups for a predetermined diet, comprising:

a housing;

respective manually displaceable indicators for each of the predetermined food groups mounted on said housing and disposed for independent displacement along distinct paths from a common origin, the displacement of each of said indicators from said common origin being respectively indicative of food amounts; and a removable card with respective encoded slots for each of the predetermined food groups for limiting the respective maximum displacements of each of said indicators from the common origin to correspond to the respective maximum amounts of foods allocated for the predetermined food groups of a selected daily calorie intake for the predetermined diet, said indicators being displaced to respective maximum displacements as defined by said encoded slots for indicating the daily maximum allowable amounts of food allocated for each predetermined food group without reference to dietary tables by the user and further monitoring pursuant to food intake the amounts of food not yet consumed, within the selected daily calorie intake, for each predetermined food group, said removable card being selectable from a plurality of removable cards, each having differing encoded slot lengths for any one good group and respectively corresponding to different predetermined daily calorie intakes, said removable card further being removed and replaced without disassembly of the remainder of the diet managment device.

2. The diet management device of claim 1 wherein the respective lengths of said encoded slots are indicative of the respective maximum amounts of food allowed for each of the predetermined food groups for the selected calorie intake associated with said removable card.

3. The diet management device of claim 2 wherein said manually displaceable indicators include detented slide means for travelling within said encoded slots and for numerically indicating the respective amounts of food which can be consumed for each of the predetermined food groups.

4. The diet management device of claim 3 wherein said detented slide means includes respective individually actuable slide members for each of the predetermined food groups.

5. The diet management device of claim 4 wherein said housing includes respective display apertures for each of the predetermined food groups, and wherein each of said slide members includes numerical indicia visible through a respective one of said housing display apertures.

6. The diet management device of claim 5 wherein said slide members include respective tabs for cooperating with respective encoded slots to allow the display of respective numerical indicia representing the maximum amounts of food for each of the predetermined food groups.

7. The diet management device of claim 6 wherein actuation of said respective tabs pursuant to the intake of food for respective food groups causes the respective display apertures to show numerical indicia representative of the respective amounts of food which can still be consumed for each of the predetermined food groups.

* * * * *